United States Patent [19]

Takimoto

[11] 4,198,356

[45] Apr. 15, 1980

[54] CONTROL SYSTEM FOR SECONDARY TRANSFER PORT IN DUAL CARBURETOR

[75] Inventor: Masatami Takimoto, Toyota, Japan

[73] Assignee: Toyota Jidosha Kogyo Kabushiki Kaisha, Toyota, Japan

[21] Appl. No.: 968,777

[22] Filed: Dec. 12, 1978

[30] Foreign Application Priority Data

May 29, 1978 [JP] Japan ..... 53/64091

[51] Int. Cl.[2] ..... F02M 7/22

[52] U.S. Cl. ..... 261/23 A; 261/41 D; 261/DIG. 74; 123/DIG. 11

[58] Field of Search ..... 261/DIG. 74, 23 A, 41 D; 123/DIG. 11

[56] References Cited

U.S. PATENT DOCUMENTS

| | | | |
|---|---|---|---|
| 2,315,052 | 3/1943 | Ericson | 261/41 D |
| 2,749,894 | 6/1956 | Sariti et al. | 261/41 D |
| 3,252,539 | 5/1966 | Ott et al. | 261/23 A |
| 3,408,054 | 10/1968 | Walker | 261/41 D |
| 3,761,063 | 9/1973 | Shibanaka et al. | 261/41 D |
| 4,050,436 | 9/1977 | Crabtree | 261/DIG. 74 |
| 4,051,824 | 10/1977 | Sugiura | 261/69 R |
| 4,103,657 | 8/1978 | Minami | 261/DIG. 74 |
| 4,124,662 | 11/1978 | Morita | 261/DIG. 74 |

FOREIGN PATENT DOCUMENTS

| | | | |
|---|---|---|---|
| 2330206 | 1/1975 | Fed. Rep. of Germany | 261/DIG. 74 |
| 2544614 | 4/1977 | Fed. Rep. of Germany | 261/41 D |
| 46-40063 | 11/1971 | Japan | 261/23 A |

*Primary Examiner*—Tim R. Miles

*Attorney, Agent, or Firm*—Stevens, Davis, Miller & Mosher

[57] ABSTRACT

Control system for a secondary transfer port in a dual carburetor used for an internal combustion engine, which control system opens the secondary transfer port by a magnet valve connected electrically to an ignition switch during the high-load operation of the engine and closes the secondary transfer port by the magnet valve during the low-load operation of the engine.

1 Claim, 2 Drawing Figures

CONTROL SYSTEM FOR SECONDARY TRANSFER PORT IN DUAL CARBURETOR

This invention relates to a fuel control system for a secondary transfer port in a dual carburetor.

If a foreign object falls accidentally into a dual carburetor in an internal combustion engine under certain circumstances, e.g., at the time of the maintenance of the vehicle, it is possible that the object will remain caught between the throttle valve and throttle bore of the secondary evaporator. In such condition, the secondary throttle valve cannot be fully closed and more fuel than necessary is drawn from the secondary transfer port under the low-load engine condition, resulting in increased fuel consumption. And it may be that the fuel is burned in the engine exhaust system to cause the exhaust-gas purifying device to be overheated or cause the engine to continue running after the engine key has been turned off. To prevent such abnormal running of the engine, a system has been used which includes a magnet valve for opening and closing the secondary transfer port at the secondary evaporator, which opens the transfer port by the magnet valve during operation of the engine and closes the transfer port by the magnet valve when the engine key has been turned off. Such a system, however, is not able to prevent excess fuel flow from the secondary transfer port when the vehicle is running with a foreign object caught in the secondary evaporator. For removal of this defect, the secondary transfer port may be provided at a higher portion than usual in the secondary evaporator. By so doing, however, the fuel/air ratio of the mixture is adversely affected when the engine load shifts from a low range to a high one (i.e., when the secondary evaporator starts to operate), with the result that the driveability of the vehicle is degraded by the engine operation becoming unsmooth.

An object of this invention is to provide a control system for a secondary transfer port in a dual carburetor used for an engine, which control system prevents a foreign object accidentally caught between a secondary throttle valve and throttle bore in the dual carburetor from causing excess fuel to flow from the secondary transfer port at the time of the low-load engine operation and therefore prevents an exhaust-gas purifying device from being overheated.

Another object of this invention is to provide a control system for a secondary transfer port in a dual carburetor used for an engine, which control system makes it possible to normally stop the engine operation by turning off the ignition switch even when a foreign object has been caught between the secondary throttle valve and throttle bore in the dual carburetor.

A further object of this invention is to provide a control system for a secondary transfer port in a dual carburetor used for an engine, which control system ensures satisfactory driveability of the vehicle by allowing the fuel to be smoothly drawn from the secondary transfer port when the engine load shifts from a low range to a high one.

Still further objects of this invention will become apparent upon a reading of the following detailed description of the invention and annexed drawings which disclose:

Figure 1:
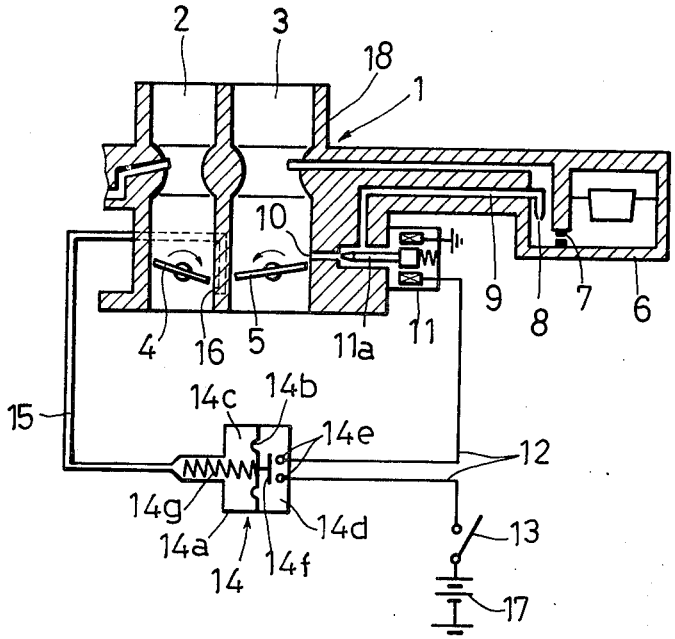
FIG. 1 shows a control system for a secondary transfer port according to the invention.

Referring to the drawings, FIG. 1 illustrates one embodiment of the invention. A dual carburetor 1 includes a primary evaporator 2, secondary evaporator 3 and float chamber 6. The evaporators 2 and 3 include a primary throttle valve 4 and secondary throttle valve 5, respectively. Numerals 7 and 8 designate a secondary main jet and secondary slow jet, respectively. The secondary slow jet 8 communicates with a secondary transfer port 10 through a passage 9. The secondary transfer port 10 is positioned slightly above the secondary throttle valve 5 when the latter 5, which is herein assumed to be turned counterclockwise, is fully closed. A magnet valve 11 is provided for the secondary evaporator 3 and has a valve rod **11*a* which is adapted to retract so as to open the secondary transfer port 10 when the magnet valve 11 is energized and move forward so as to close the port 10 when the valve 11 is deenergized. The magnet valve 11 is connected to an ignition switch 13 by way of an electric circuit 12 to which is connected a negative-pressure switch 14. Within a casing 14*a*, the switch 14 has a diaphragm 14*b* which divides the inside of the casing 14*a* into two chambers, i.e. a negative-pressure chamber 14*c* and atmospheric-pressure chamber 14*d*. The chamber 14*d* is provided with two fixed contacts 14*e* connected to the electric circuit 12 and a movable contact 14*f* attached to the diaphragm 14*b*. A compression spring 14*g* is provided in the negative-pressure chamber 14*c*. The chamber 14*c* communicates with a negative-pressure port 16 provided in the primary evaporator 2 by way of a negative-pressure passage 15. The negative-pressure port 16 is positioned slightly under the primary throttle valve 4 when the latter 4, which is herein assumed to be turned clockwise, is fully closed. Numeral 17** designates a power source.

Attention is next directed to the operation of the control system. The ignition switch 13 remains closed during the operation of the engine. When the engine is operated with low load, the negative pressure at the negative-pressure port 16 is so high that the diaphragm **14*b* in the switch 14 moves to the left (in FIG. 1) against the action of the spring 14*g* with the movable contacts 14*f* moving away from the fixed contact 14*e* so as to open the electric circuit 12. Therefore, an electric current does not flow to the magnet valve 11 and the valve rod 11*a* is caused to close the secondary transfer port 10**.

Increase in the engine load causes the primary throttle valve 4 to start to turn clockwise. When the right end (in FIG. 1) of the primary throttle valve 4 has turned past the negative-pressure port 16, the negative pressure at the port 16 is so decreased that the diaphragm **14*b* in the switch 14 moves to the right (in FIG. 1) with the movable contact 14*f* coming in contact with the fixed contact 14*e* so as to close the electric circuit 12. The magnet valve 11 is thus energized and the valve rod 11*a* is retracted to open the secondary transfer port 10. When the primary throttle valve 4 has opened to a predetermined degree (that is, a predetermined high load has been applied to the engine), and interlocking device (not shown) causes the secondary throttle valve 5 to start to open (i.e. turn counterclockwise). When the right end (in FIG. 1) of the secondary throttle valve 5 has turned to above the secondary transfer port 10, the fuel is drawn form the secondary transfer port 10. When the primary throttle valve 4 is fully opened, the secondary throttle valve 5 is also fully opened to cause further fuel to be drawn from a main nozzle 18 of the secondary evaporator 3**.

Figure 2:
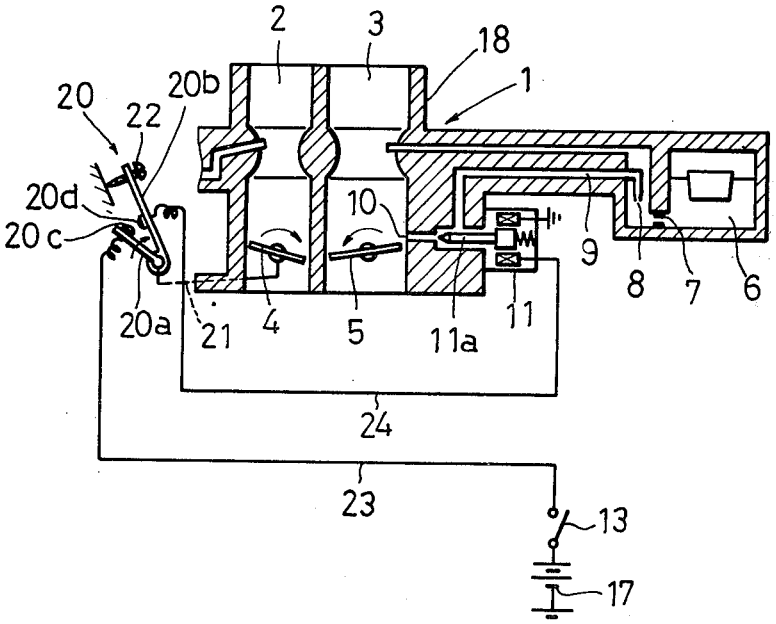
FIG. 2 shows another control system for a secondary transfer port according to the invention.

Attention is next directed to a second embodiment of the invention shown in FIG. 2. Components similar to those of FIG. 1 are given the same numerals, but no explanation. Numeral 20 designates a switch for adjusting the degree of openness of a primary throttle valve 4. The switch 20 comprises a movable lever 20*a* with a moveble contact 20*c* and a fixed lever 20*b* with a fixed contact 20*d*. The movable lever 20*a* is connected to the primary throttle valve 4 by ε link means 21 so that the lever 20*a* can turn when the valve 4 turns. The fixed lever 20*b* is provided with an adjust screw 22 which makes it possible to adjust the position of the lever 20*b* and the operation-start position of the switch 20. The movable and fixed contacts 20*c* and 20*d* are connected to the terminal of an ignition switch 13 through an electric circuit 23 and to a magnet valve 11 through an electric circuit 23 and to a magnet valve 11 through an electric circuit 24, respectively.

When the engine is in operation, the ignition switch 13 remains closed. When the engine is operated with low load, the primary throttle valve 4 is opened to a small degree and the movable contact 20*c* of the switch 20 is spaced form the fixed contact 20*d*. Therefore, the magnet valve 11, being deenergized, closes a secondary transfer port 10 with its valve rod 11*a* to prevent the fuel from being drawn from the port 10.

When an increase in the engine load causes the primary throttle valve 4 to turn clockwise, the movable lever 20*a* of the switch 20 also turns clockwise by the presence of the link means 21 provided therebetween. When the primary throttle valve 4 has turned or opened to a predetermined degree, the movable contact 20*c* of the switch 20 comes into contact with the fixed contact 20*d* to energize the magnet valve 11. The valve rod 11*a* thus opens the secondary transfer port 10 to cause the fuel to be drawn from the port 10.

What we claim is:

1. A control system for a secondary transfer port in a dual carburetor for an internal combustion engine, said control system comprising:

an ignition switch;

a primary evaporator having a first throttle valve therein;

a secondary evaporator having a second throttle valve therein and a transfer port opening thereinto;

a magnet valve for opening and closing the transfer port;

an electric circuit between said magnet valve and said ignition switch;

an adjusting switch in said circuit for closing it during high load engine operation to open the transfer port and for opening the circuit during low load operation to close the transfer port, said switch comprising:

a lever pivotable in accordance with the degree of openness of the first throttle valve, said lever having a first contact thereon and being adapted to pivot throught a link means provided between the lever and the first throttle valve when it is rotated, said first contact being electrically connected to said ignition switch; and a fixed contact contactable by said first contact, said fixed contact being electrically connected to said magnet valve.

* * * * *